US010238188B2

(12) United States Patent
Kim

(10) Patent No.: US 10,238,188 B2
(45) Date of Patent: Mar. 26, 2019

(54) WEARABLE SMART BAND

(71) Applicants: Spheredyne Co., LTD., Seoul (KR); Sug Whan Kim, Gimpo-si (KR)

(72) Inventor: Sug Whan Kim, Gimpo-si (KR)

(73) Assignees: Spheredyne Co., Ltd., Seoul-si (KR); Sug Whan Kim, Gimpo-si, Gyeonggi-do (KR)

( * ) Notice: Subject to any disclaimer, the term of this patent is extended or adjusted under 35 U.S.C. 154(b) by 0 days.

(21) Appl. No.: 15/522,604

(22) PCT Filed: Oct. 27, 2015

(86) PCT No.: PCT/KR2015/011360

§ 371 (c)(1),
(2) Date: Apr. 27, 2017

(87) PCT Pub. No.: WO2016/068566

PCT Pub. Date: May 6, 2016

(65) Prior Publication Data

US 2018/0103729 A1 Apr. 19, 2018

(30) Foreign Application Priority Data

Oct. 27, 2014 (KR) ..... 10-2014-0146389

(51) Int. Cl.
*A44C 5/00* (2006.01)
*A45C 13/30* (2006.01)
(Continued)

(52) U.S. Cl.
CPC ..... *A44C 5/003* (2013.01); *A44C 5/00* (2013.01); *A44C 5/0007* (2013.01);
(Continued)

(58) Field of Classification Search
CPC ... A45F 2005/008; A45C 5/00; A45C 5/0007; A45C 5/003; A45C 5/0015–5/0092;
(Continued)

(56) References Cited

U.S. PATENT DOCUMENTS 1,453,880 A * 5/1923 Ludwig ..... F41C 33/0209 224/196
1,906,870 A * 5/1933 Palla ..... F41C 9/00 42/1.11

(Continued)

*Primary Examiner* — Scott McNurlen
(74) *Attorney, Agent, or Firm* — Pearl Cohen Zedek Latzer Baratz LLP

(57) ABSTRACT

A wearable smart band and comprises a fixing band provided so as to be wearable on a joint of a user including a human, an animal, a machine, etc; a receptacle member formed on the fixing band so that a tool, a machine part, a device, and an information device is located, and having an upper part covered by a cover; a flexible band provided on one side of the fixing band, whereof the shape of the fixing band is transformed according to movement of the user's joint; and an inserting and drawing assembly having one end connected to the flexible band and the other end connected to the information device or the cover, wherein the information device or cover is drawn or inserted from or into the receptacle member by the transformation of the flexible band according to the movement of the user's joint.

17 Claims, 10 Drawing Sheets

(51) Int. Cl.

| | |
|---|---|
| ***A44C 5/10*** | (2006.01) |
| ***A45F 5/00*** | (2006.01) |
| ***A44C 5/14*** | (2006.01) |

(52) U.S. Cl.

CPC ..... *A44C 5/0061* (2013.01); *A44C 5/0084* (2013.01); *A44C 5/105* (2013.01); *A44C 5/14* (2013.01); *A45C 13/30* (2013.01); *A45F 5/00* (2013.01)

(58) Field of Classification Search

CPC .... A61F 5/013; A61F 2005/0169; A44C 5/00; A44C 5/0007; A44C 5/003; A44C 5/0015–5/0092; A44C 5/105; A44C 5/14

USPC ..... 224/164–179, 196, 217–222, 267; 472/73; 273/148 R, 148 A, 149 P, 150; 602/21

See application file for complete search history.

(56) References Cited

U.S. PATENT DOCUMENTS

| | | | | | |
|---|---|---|---|---|---|
| 3,060,625 | A * | 10/1962 | Glass | F41C 9/00 | 16/307 |
| 3,793,759 | A * | 2/1974 | Deckard | F41C 23/04 | 42/1.11 |
| 4,677,971 | A * | 7/1987 | Lindemann | A61F 5/013 | 473/62 |
| 5,653,680 | A * | 8/1997 | Cruz | A61F 5/013 | 482/45 |
| 6,696,986 | B1 * | 2/2004 | Harrison, Jr. | G06F 1/163 | 224/219 |
| 8,567,832 | B2 * | 10/2013 | Kannaka | A45F 5/00 | 224/218 |
| 2007/0054555 | A1 * | 3/2007 | Yeh | A45F 5/00 | 439/607.05 |
| 2009/0088230 | A1 * | 4/2009 | Park | C02F 1/325 | 455/575.6 |
| 2016/0286945 | A1 * | 10/2016 | Kim | B25F 1/003 | |

* cited by examiner

WEARABLE SMART BAND

CROSS-REFERENCE TO RELATED APPLICATIONS

This application is a National Phase Application of PCT International Application No. PCT/KR2015/011360, International Filing Date Oct. 27, 2015, claiming priority of Korean Patent Application No. 10-2014-0146389, filed Oct. 27, 2014, which is hereby incorporated by reference in its entirety.

FIELD OF THE INVENTION

The present disclosure relates to a wearable smart band that is wearable on a joint of a user including a human, an animal, and a machine. More specifically, the present disclosure relates to a wearable smart band in which an information device or a cover of a variety of tools, machine parts such as a watch, a smart device, or the like is automatically drawn or inserted by the joint movement of a human wrist, for example.

BACKGROUND OF THE INVENTION

In recent years, as the miniaturization of smart information devices such as mobile phones has been rapidly spreading and the multi-functional miniaturization trends have been developed, the mobile phones have become a necessity for modern people. Therefore, the mobile phones are becoming smaller and smaller in size by the device manufacturers and are being developed so that the users can carry it easily.

Among them, information devices such as smart watches, for example, information devices such as mobile communication terminals currently available on the market are mainly made of terminals capable of being held in the hands. In such a case, when the information device is held in a bag or clothes pocket in a place where human is much crowded or noisy, the user of the information device often fails to detect vibration and ringing of the information device. In addition, the information device is often lost unconsciously if it is held or carried in a garment pocket.

In addition, the user of the information device has the information device fixed to the body for detecting the incoming signal, for eliminating the risk of loss, and for convenience of use. For example, the user may attach an annular string to the information device and hang it on his wrist or attach a necklace string and hold it on his neck. In recent years, there have been a lot of information devices that can carry in a safe place such as a bag and make or receive calls by connecting the information device to an earphone or microphone. However, since these information devices may be connected and fixed to the user's body in the form of a line, when the user moves, the line and the information device move together and the user feels quite uncomfortable. Also, since these information devices are equipped with electric wires, switches, earphones, microphones, etc., there has been a complicated and cumbersome inconvenience when the user wears it.

In order to eliminate the inconvenience of carrying the information devices as mentioned above, the combined products of an information device that can be worn on a user's wrist, such as a smart watch, have been developed. However, since these products are more expensive and less practical than existing information devices, these products are being put back in the information device market. Thus, it is required to devise and develop a new device or product that allows a user to carry an information device so that it can be easily attached and detached without inconveniencing the user's activities even if the product is fixed to the user's body.

PRIOR ART DOCUMENT (Patent Document 1) Korean Laid-Open Publication No. 10-2005-0112617 (Dec. 1, 2005.)

SUMMARY OF THE INVENTION

The present disclosure is to solve the above-mentioned problems and in particular, the present disclosure is to provide a wearable smart band designed to be widely used in a joint of a human, an animal and a machine, which automatically draws or inserts various tools, machine parts, information devices or covers by only a bending movement of a joint movement of a user's wrist without supplying an additional other external power, and that further improves aesthetics due to the pattern of the cover, when a user is a human.

It is to be understood by those skilled in the art that both the foregoing general description and the following detailed description are exemplary and explanatory and are not intended to limit the disclosure.

In order to achieve the above object, the wearable smart band of the present disclosure may include a fixing band provided so as to be wearable on a joint of a user including a human, an animal and a machine; a receptacle member formed on the fixing band such that a tool, a machine part or an information device is arranged, and having an upper part covered by a cover; a flexible band provided on one side of the fixing band, wherein a shape of the flexible band is transformed due to a joint movement of the user; and an inserting and drawing assembly having one end connected to the flexible band and the other end connected to the tool, the machine part, the information device or the cover, wherein the tool, machine part, the information device or the cover is drawn or inserted from/into the receptacle member by the transformation of the flexible band according to the joint movement of the user. [11] Further, the fixing band may be a band type structure in which the receptacle member is fixedly mounted. In this case, the fixing band can be provided so that the shape of one part or the whole of the fixing band may be not changed when the one part or the whole of the fixing band receives an external force exerted by the user, or the shape of one part or the whole may be slightly changed when the one part or the whole of the fixing band receives an external force exerted by the user. In particular, the fixing band can be provided so as to maintain the integrity of the whole band form whenever the external force is received or not. When the external force exerted by the user is received, a deformable portion of the fixing band has a significantly smaller deformation amount than the flexible band.

Further, the receptacle member may include a first guide member to guide the movement of the tool, the machine part, the information device or the cover to be drawn or inserted from/into the receptacle member, and the tool, the machine part, the information device or the cover may include a guide protrusion received in a guide groove formed along the length direction of the first guide member. [13] Further, the flexible band may be connected to one end of the fixing band by means of a flexible material or a flexible structure such as a cloth, a leather, a rubber, a plastic or a metal mesh.

Further, the flexible band may include at least one fixing member to which one end of the inserting and drawing assembly is connected.

Further, the flexible band may have different circumferential lengths at one end and the other end thereof.

Further, the inserting and drawing assembly may include at least one first wire having one end connected to one end to the flexible band and the other end connected to one end to the tool, the machine part, the information device or the cover to perform the action of pulling the tool, the machine part, the information device or the cover, which will be explained as the first embodiment of the present disclosure.

Further, the inserting and drawing assembly may include: at least one second wire having one end connected to the flexible band to perform the action of pulling the tool, the machine part, the information device or the cover; a first link member connected to the other end of the second wire; a second link member connected to one end of the first link member, and having one end connected to the other end of the tool, the machine part, the information device or the cover; and a rotating member rotatably provided between the first link member and the second link member to transmit a rotational force of the first link member to the second link member, wherein the tool, the machine part, the information device or the cover is drawn or inserted from/into the receptacle member by the rotation of the first link member and the second link member when the second wire is tensioned or compressed by deformation of the flexible band according to the joint movement of the user, which will be explained as the second embodiment of the present disclosure.

Further, the inserting and drawing assembly may further include a roller member provided on one end of the second link member. The roller member is received in a roller guide formed on the other side of the tool, the machine part, the information device or the cover to guide the movement of the one end of the second link member.

Further, the inserting and drawing assembly may further include a sliding member provided on the one end of the second link member. The sliding member is received in a roller guide formed on the other side of the tool, the machine part, the information device or the cover to guide the movement of the one end of the second link member.

Further, the inserting and drawing assembly may further include at least one elastic member having one end connected to the other end of the tool, the machine part, the information device or the cover and the other end connected to the other end of the inner side of the receptacle member to return the tool, the machine, the information device or the cover to the original position.

Further, the first wire or the second wire may be formed to include an elastic material, but can be operated without elasticity.

Further, a predetermined pattern including numbers, symbols, and graphics may be formed on the outer surface or the inner surface of the tool, the machine, the information device, or the cover.

Further, the inserting and drawing assembly may include: a third link member having one end connected to one end of the second link member and the other end contacted with the other side of the tool, the machine part, the information device or the cover; and an extended rotating member rotatably provided between the second link member and the third link member to transmit the rotational force of the second link member to the third link member. This configuration of the inserting and drawing assembly will be described in the third embodiment of the present disclosure.

Further, the inserting and drawing assembly may include: a second wire having one end connected to the flexible band; and a second link member connected to the other end of the second wire and having the other end connected to the other end of the tool, the machine part, the information device or the cover, which will be explained as the fourth embodiment of the present disclosure.

Further, the inserting and drawing assembly of the fourth embodiment may further include a support member fixedly mounted on the bottom surface of the space portion for supporting the second wire to guide the direction in which the second wire is pulled in a direction in which the wrist is bent, which will be described as the fifth embodiment of the present disclosure.

Further, the inserting and drawing assembly may be arranged to perform an upright movement in the direction of the cover from the floor part of the receptacle member to operate the tool, the machine part, the information device or the cover operates in a hinge manner, which will be described as the sixth embodiment of the present disclosure.

According to the present disclosure, the user is only executed by a joint movement of a user's wrist in order to automatically draw or insert a machine part, an information device, a tool, a cover and the like such as a watch from/into a fixing band worn on the user's wrist, thereby improving convenience and preventing loss of expensive products such as smart devices and watches. In particular, it is not necessary to use an external power source such as a battery due to a bending force of the user' joint to draw out the machine part, the information device, the tool or cover, which is a target of a drawing out and drawing in. Furthermore, the built-in machine part or information device can be protected by a removable external cover, which dramatically enhances the function of secure storage and protection against breakage.

Further, according to the present disclosure, there is an advantage that can improve an aesthetic property due to a pattern of the cover covering the machine part or information device and can be used as an accessory such as a bracelet which can include an analog watch inside and outside.

DETAILED DESCRIPTION OF THE INVENTION

Figure 1:
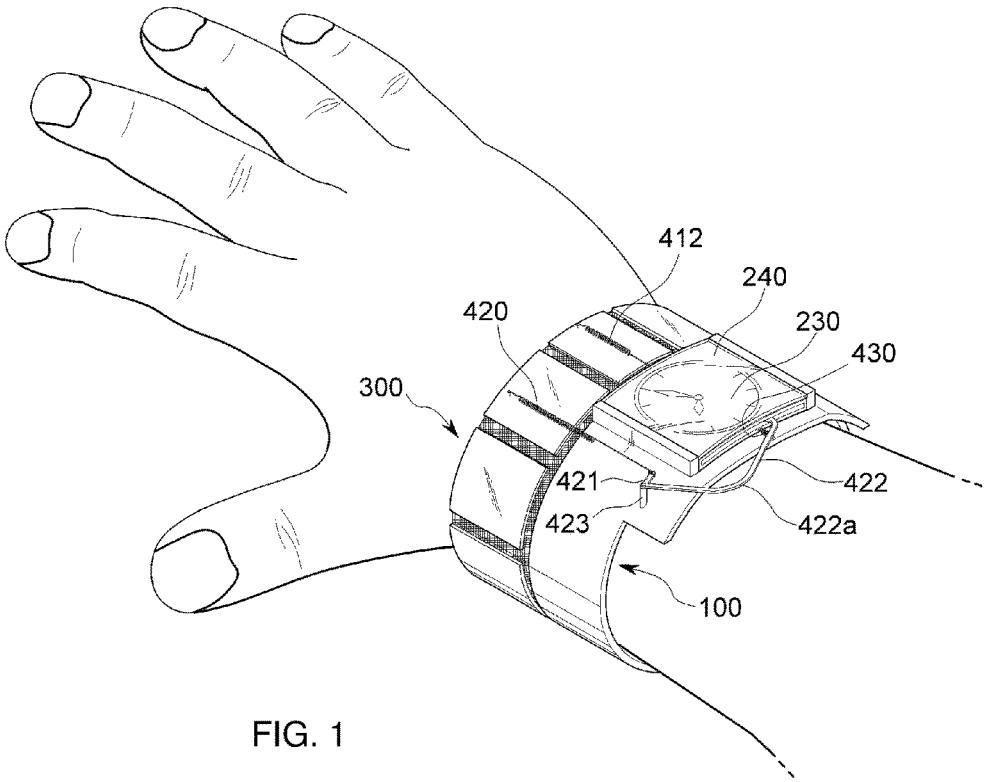
FIGS. 1 and 2 are perspective views illustrating operational states in which a wearable smart band is mounted on a user's wrist if the user is a human, and a tool, a machine part, an information device or a cover is drawn when a joint of the user's wrist is bent, and is inserted when the joint of the user's wrist is extended in accordance with the present disclosure.

Hereinafter, the embodiments according to the present disclosure will be described in detail with reference to the accompanying drawings. More specifically, the first to fifth embodiments will be described based on a sliding type inserting and drawing mechanism for a tool, a machine part, an information device or cover with respect to an operation mechanism for an inserting/drawing assembly, and additionally, the sixth embodiment will be described based on a hinge type inserting and drawing mechanism for the tool, the machine part, the information device or cover using the mechanism of any one of the first to fifth embodiments separately.

In the embodiments, the sizes and shapes of the components shown in the drawings may be exaggerated for clarity and convenience. In addition, terms defined in consideration of the configurations and operations of the present disclosure may vary depending on the intentions of users, operators, or practices. Definitions of these terms should be based on the content of this specification. Of course, it will be apparent to those skilled in the art that various modifications and variations can be made in the present disclosure without departing from the spirit or scope of the disclosures.

Figure 2:
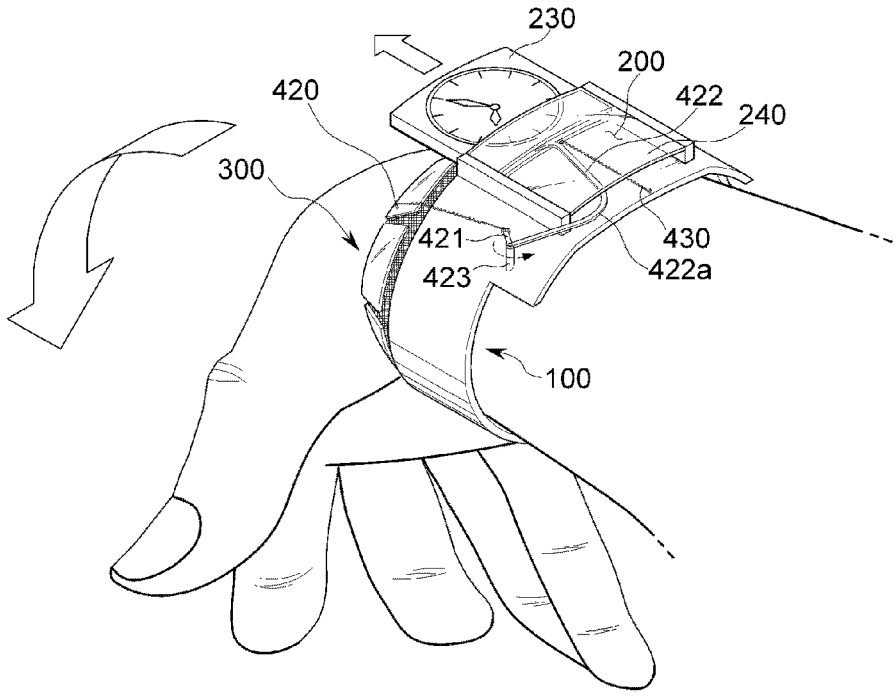

FIGS. 1 and 2 are operational conceptual diagrams of the wearable smart band in accordance with the present disclosure, which can be worn on a joint of a human, an animal and a machine, but showing operational states mounted on a user's wrist and operated in a sliding manner as an example for the clarity of the description. With reference to FIGS. 1 and 2, the overall configuration and operating states of the wearable smart band will be described in detail.

As shown in FIGS. 1 and 2, the wearable smart band is designed to be automatically inserted and drawn according to only a bending movement such as the simple joint movement by the user's wrist having a bendable structure including a joint such as a human, an animal, or a machine, etc. The wearable smart band is configured to include a fixing band 100, a receptacle member 200, a flexible band 300, and an inserting and drawing assembly which can be operated only by a bending movement of a joint of a user's wrist without supplying an additional external power such as a power, such that a tool, a machine part, an information device or cover, etc.

The fixing band 100 is provided in the form of a band that can be worn on a wrist, an ankle or knee joint of the user when the user is a human. According to one embodiment of the present disclosure, the fixing band is worn on the wrist of a user. Specifically, the fixing band 100 is worn on an arm portion adjacent to the user's wrist, since the bending or deforming of the fixing band 100 to the movement direction side of the wrist's joint is minimized as much as possible even if the joint movement of the user's wrist is performed.

The fixing band 100 may be a band type structure in which the receptacle member 200 is fixedly mounted. In this case, the fixing band 100 can be provided so that the shape of one part or the whole of the fixing band 100 may be not changed when receiving an external force exerted by the user, or the shape of one part or the whole may be slightly changed. In particular, the fixing band can be provided so as to maintain the integrity of the whole band form whenever the external force is received or not. When the external force exerted by the user is received, a deformable portion of the fixing band 100 has a smaller deformation amount than the flexible band 300.

The receptacle member 200 is formed on one side of the fixing band 100 and provides a space in which a machine part such as a clock or a smart device, an information device 230 or a tool may be disposed. Preferably, the receptacle member 200 is formed to open towards the top of the wrist so that the user can easily view the machine part or the information device 230. In addition, a cover 240 is arranged on the receptacle member 200 to safely shield the space where the tool, the machine part or the information device 230 are disposed from the external influences such as impact and temperature and humidity changes.

The flexible band 300 is formed on one side of the fixing band 100 and includes a flexible material or a flexible structure that can be deformed according to the joint movement of the user's wrist. More specifically, the flexible band 300 may be formed to include at least one of cloth, leather, plastic, rubber, and metal and to include a flexible material so that the shape of the flexible band 300 can be deformed when a force is applied due to a joint movement of a user.

In other words, the flexible band 300 is disposed at a joint portion of the user's wrist such that the shape thereof may be modified to correspond to the joint movement of the user's wrist and an operation in which first or second wires described later is pulled out can be performed when the joint of the user's wrist is bent.

The inserting and drawing assembly performs a role of inserting and drawing the information device 230 or the cover 240 from the receptacle member 200 by the deformation of the flexible band 300 caused by the joint movement of the user's wrist.

The inserting and drawing assembly is connected at one end to the flexible band 300 and at the other end to the tool, the machine part, information device 230 or cover 240. For the specific embodiments, it will be described later.

According to the above-described configurations, the wearable smart band allows the tool, the machine part or the information device to maintain a state of being inserted into the receptacle member 200 when the user's wrist does not move any joint movement, that is, when the user's wrist is straightened as shown in FIG. 1.

In addition, when the user's wrist performs a joint movement to one side as shown in FIG. 2, that is, when the user's wrist is bent to the one side, the wearable smart band permits the tool, the machine part or the information device 230 to be drawn from the receptacle member 200 by a sliding movement.

Meanwhile, although FIGS. 1 and 2 illustrate that the object to be drawn or inserted from/into the receptacle member 200 is the information device 230, it will be appreciated that the cover 240 can be drawn or inserted from/into the receptacle member 200 by the sliding movement in a state where the other end of the inserting/drawing assembly is connected to the cover 240 and the tool, the machine part or information device 230 is fixedly disposed on the receptacle member 200.

Hereinafter, specific functions and operations of the wearable smart band will be described with reference to embodiments. In these cases, first to fifth inserting and drawing assembly that operate on the same principle will be firstly described in detail by applying to the inserting and drawing method of the sliding type with the sliding movement. In relation to the first to fifth inserting and drawing assembly, a sixth embodiment will be described as the inserting and drawing assembly of a hinge type in which the tool, the machine part, the information device 230 or cover 240 is raised from the bottom of the receptacle member 200 and laid down is arranged.

Figure 3:
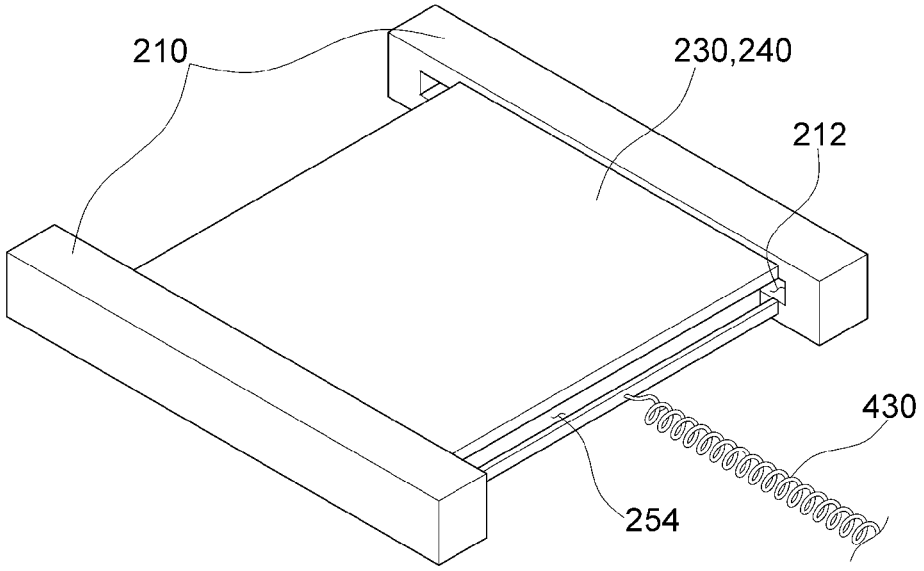
FIG. 3 is a perspective view illustrating a tool, a machine part, an information device or a cover provided in a receptacle member of a wearable smart band in accordance with the present disclosure.
Figure 4:
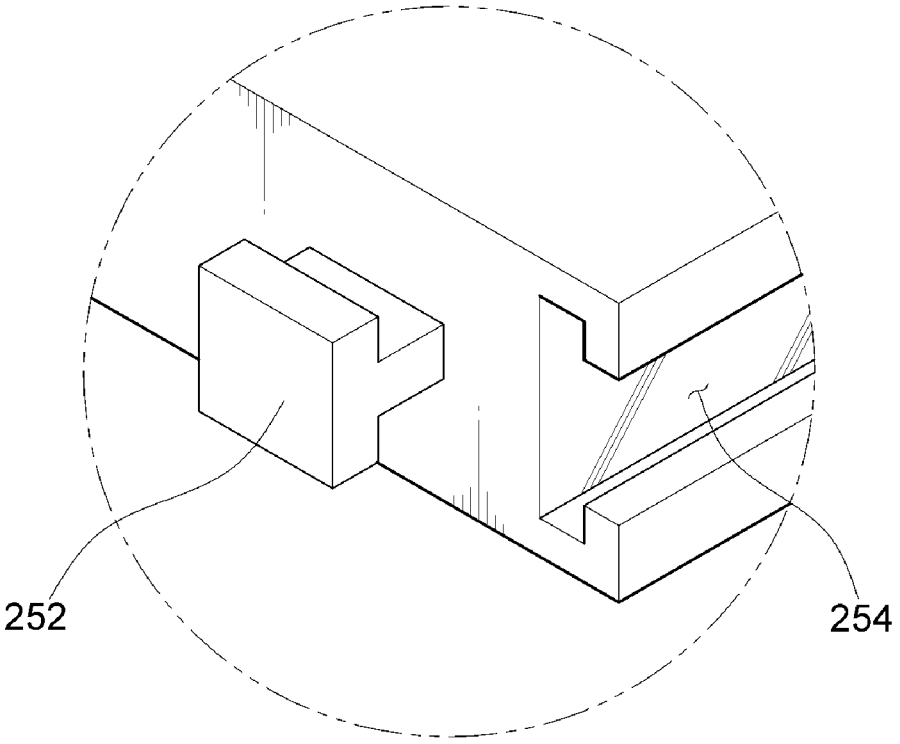
FIG. 4 is an enlarged perspective view illustrating a guide protrusion and a guide groove provided at one side of a tool, a machine part, an information device, or a cover provided in a receptacle member of a wearable smart band in accordance with the present disclosure

FIGS. 3 and 4 are perspective view showing the information device 230 or the cover 240 that can be provided in the receptacle member of the wearable smart band and an enlarged perspective view showing one side thereof, respectively, in accordance with the present disclosure. The internal structure and arrangement of the receptacle member will be described in detail with reference to FIGS. 3 and 4.

Referring to FIGS. 3 and 4, the receptacle member 200 includes a first guide member 210 for guiding the movement of the tool, the machine part, the information device 230, or the cover 240 inserted or drawn into/from the inner space.

The first guide member 210 may be desirably provided on one side of the tool, the machine part, the information device 230, or the cover 240, or otherwise may be provided on both sides thereof. When the first guide member 210 is provided on both sides, it is extended parallel to each other in the receptacle member 200 at a predetermined distance from each other.

Further, a guide groove 212 is formed on the inner side of the first guide member 210 along the longitudinal direction of the first guide member 210. The guide groove 212 receives a guide protrusion 252 provided on one side or both sides of the tool, the machine part, the information device 230, or the cover 240 such that one or both sides of the tool, the machine part, the information device 230 or the cover 240 may be supported. Also, the movement of the tool, the machine part, the information device 230 or the cover 240 may be guided and the detachment thereof may be prevented at the same time.

According to the present disclosure, when the tool, the machine part, or the information device 230 is drawn or inserted from/into the receptacle member 200, the first guide member 210 guides the movement of the tool, the machine device or the information device 230. Meanwhile, when the cover 240 is drawn or inserted from/into the receptacle member 200, the first guide member 210 guides the movement of the cover 240 while the information device 230 to be positioned below the cover 240 is in a fixed state (in this case, only the cover 240 is shown in FIG. 3, but the information device will be located under the cover 240).

On the other hand, the tool, the machine part, the information device 230 or the cover 240 has a roller guide 254 formed on the other side thereof and an elastic member 430 connecting the other side with the inner side of the receptacle member 200, which are interlocked with the inserting and drawing assembly, and the description thereof will be given later.

FIGS. 5*a* to 5*e* are views showing various embodiments of the flexible band 300 of the wearable smart band of the present disclosure. With reference to FIGS. 5*a* to 5*e*, the specific structures and materials of the flexible band 300 will be described in detail.

The flexible band 300 is provided on one side of the fixing band 100 as described above. The flexible band 300 is formed to include a flexible material or a flexible structure such as a mesh 310 of a leather, a rubber, a plastic or metal and is connected to one end of the fixing band 100, such that the shape thereof can be modified to be correspond to the joint movement of the user's wrist. More specifically, the flexible band 300 may include a non-flexible rigid object as well as the flexible material or the flexible structure. For example, it is preferable that the flexible portion and the non-flexible fixing member 320 are combined.

In addition, since the shape of the flexible band 300 is modified due to the joint movement of the user's wrist, it is possible to prevent the position of the flexible band 300 from deviating from the position of the wrist. Also, it is preferable that the fixing band 100 and the binding site are formed integrally with each other to preserve the flexibility to move the tool, the machine part, the information device 230 or the cover 240 by means of the first wire 412 or the second wire 420.

Figure 5A:
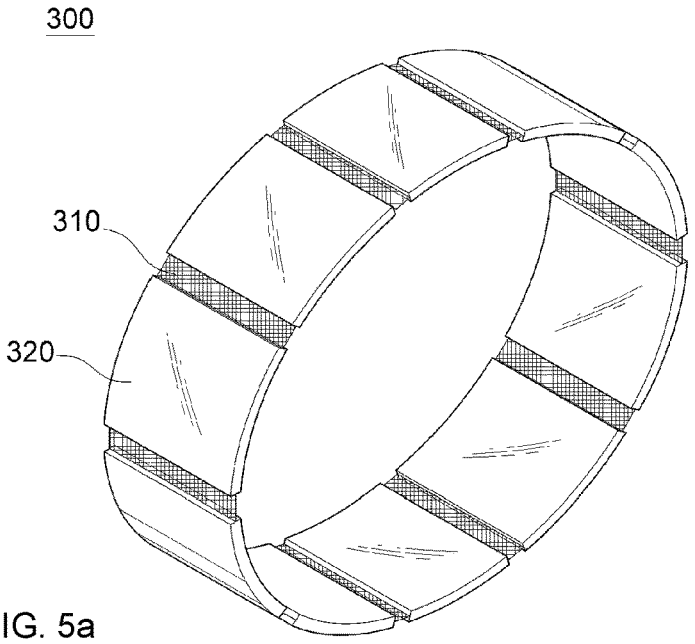
FIG. 5*a* to 5*e* are views illustrating various embodiments in which a flexible mesh and a fixing member of a flexible band of a wearable smart band are configured in various combinations in accordance with the present disclosure.

Referring to FIG. 5*a*, the flexible band 300 includes at least one fixing member 320 disposed between the meshes 310. The fixing member 320 may be formed of a material that is relatively harder than the mesh 310, since one end of the inserting and drawing assembly has to be connected and pulled for drawing or inserting the information device 230 or the cover 240 by means of the first wire 412 or the second wire 420 according to the deformation of the flexible band 300.

Figure 5B:
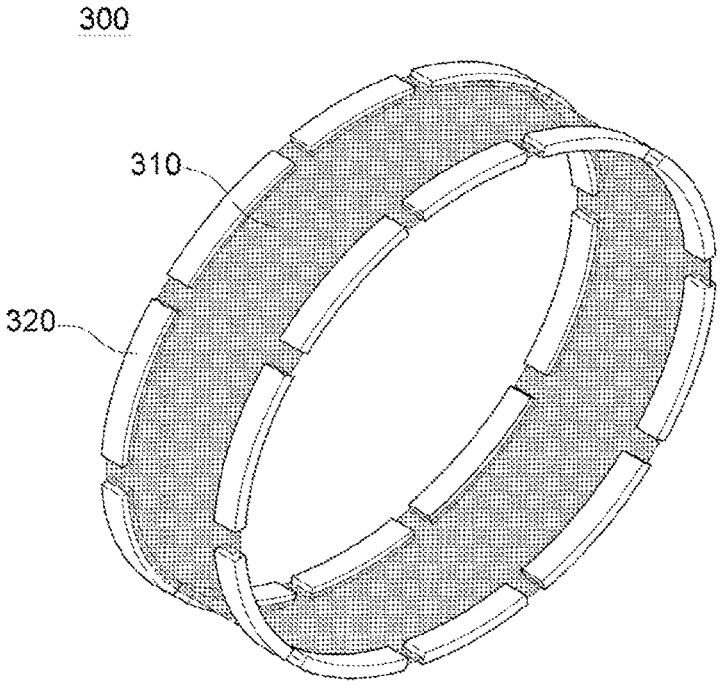
Figure 5C:
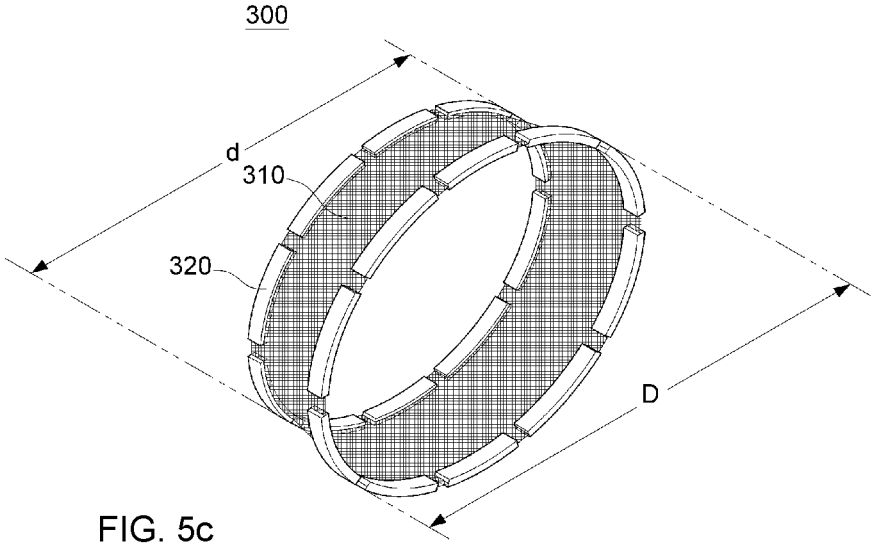

Referring to FIG. 5B, the fixing member 320 may be formed in a bar shape having a predetermined length, and may be disposed at both ends of the flexible band 300 at predetermined intervals.

The flexible band 300 has flexibility. Accordingly, even if the circumferential lengths of one end and the other end of the flexible band 300 are formed to be equal to each other, the flexible band 300 can be worn while wrapping the user's wrist portion to perform the function regardless of the size and shape of the user's wrist. Meanwhile, referring to FIG. 5*c*, the circumferential lengths of the one end and the other end of the flexible band 300 may be different from each other. This is to be formed in a shape corresponding to the shape of the flexible band 300 to uniformly improve the adhesiveness to the user's wrist at all contact portions, since the user's area increases from the wrist portion to the palm of the hand.

That is, the diameter D of one end of the flexible band 300 is set to be larger than the diameter d of the other end, and the one end of the flexible band 300 is disposed adjacent to the palm side of the hand and the other end thereof is disposed adjacent to the user's wrist. Accordingly, the arrangement position of the flexible band 300 is not released even if the joint movement of the user's wrist is repeatedly performed.

Figure 5D:
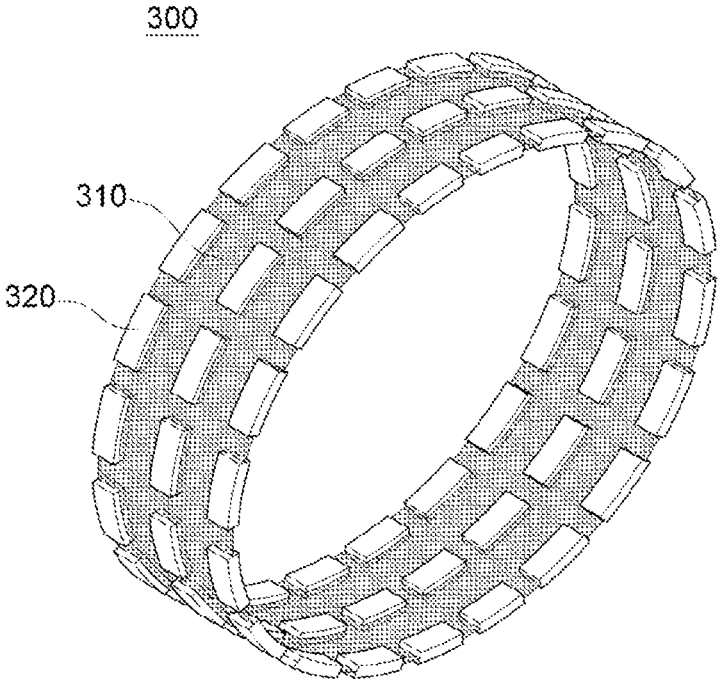

Referring to FIG. 5*d*, a plurality of fixing members 320 may be arranged in various forms on the both ends and the circumferential surface of the mesh 310. The arrangement of the fixing members 320 may be changed in various patterns, thereby improving the aesthetics.

Figure 5E:
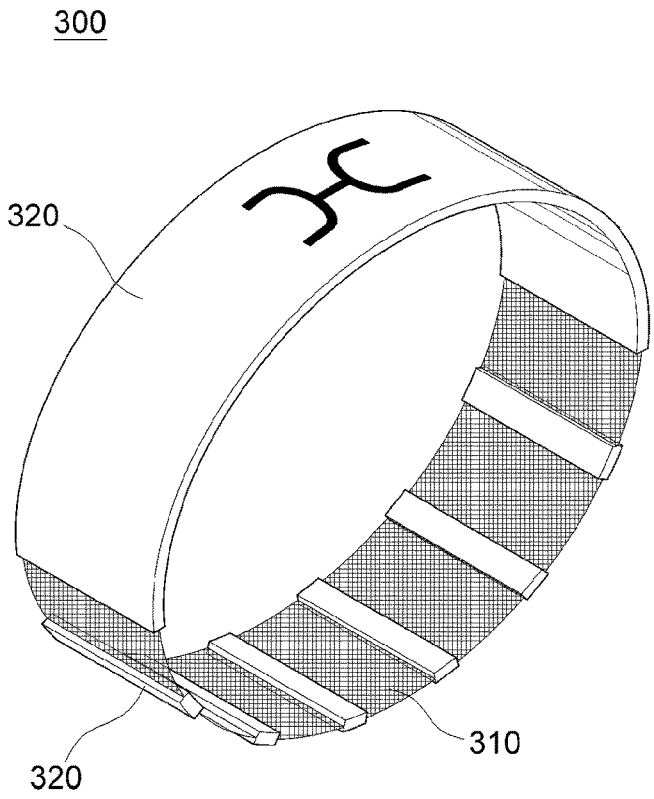

Referring to FIG. 5*e*, one of the fixing members 320 may be formed to be longer in the circumferential direction so as to cover the upper part of the user's wrist and the plurality of fixing members 320 formed to be shorter in the lower portion of the user's wrist and the flexible meshes 310 may be combined with each other. In this example, it is obvious that the fixing member 320 formed to be elongated in the circumferential direction can be provided with various patterns on its surface, thereby improving the aesthetics.

Figure 6:
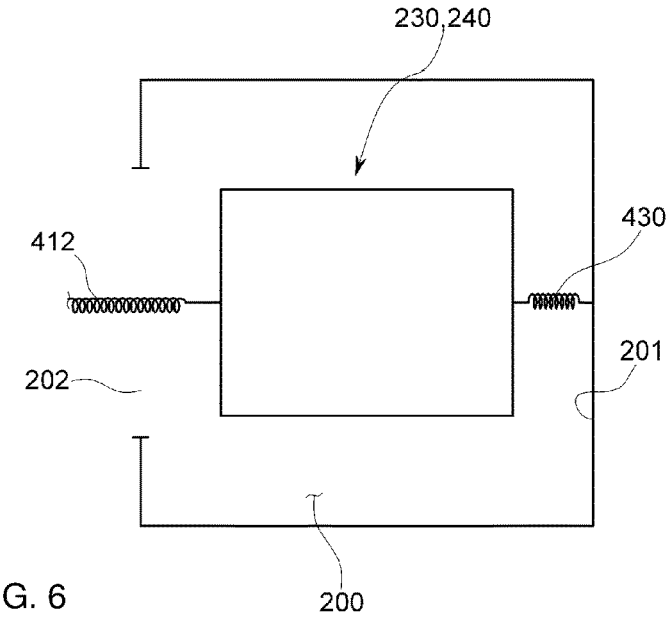
FIGS. 6 and 7 are plan views illustrating an operating state of a sliding type inserting and drawing assembly of a wearable smart band using a first wire and an elastic member in accordance with a first embodiment of the present disclosure.
Figure 7:
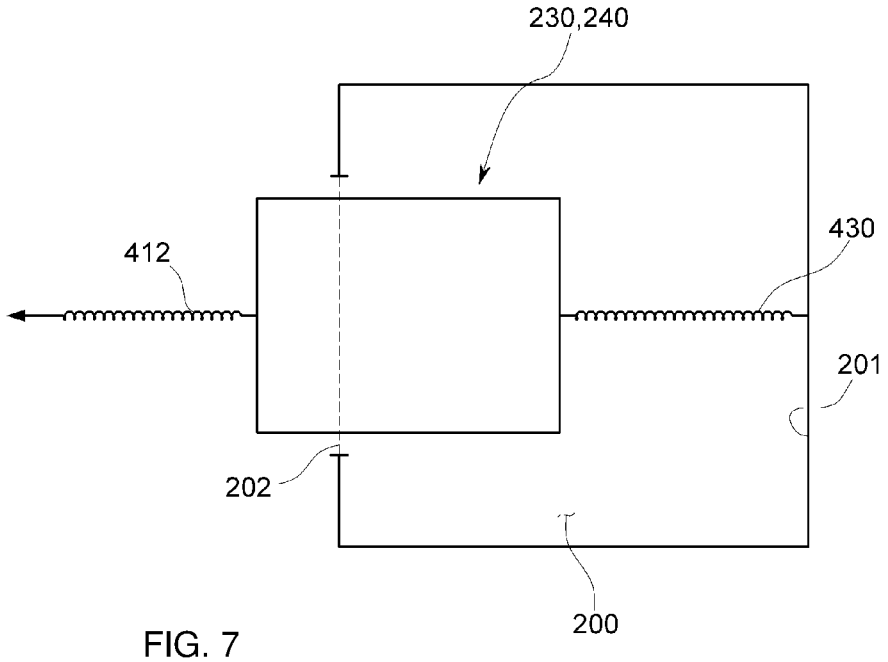

FIGS. 6 and 7 are plan views illustrating an inserting and drawing assembly of a wearable smart band, in accordance with a first embodiment of the present disclosure. With reference to FIGS. 6 and 7, the construction and operation of the inserting and drawing assembly according to the first embodiment of the present disclosure will be described in detail.

Referring to FIGS. 6 and 7, the inserting and drawing assembly according to an embodiment of the present disclosure includes a first wire 412, and an elastic member 430.

The first wire 412 is connected at one end to the fixing member 320 of the flexible band 300 and at the other end to one side of the tool, the machine part, the information device 230 or the cover 240, and it is preferable for the first wire that at least one is provided. The first wire 412 may be formed of an elastic material or a non-elastic material.

In addition, the elastic member 430 is connected at the one end to the other end of the information device 230 or the cover 240 and at the other end to the inner side of the receptacle member 200.

Looking at the operation of the inserting and drawing assembly, when the joint of the user's wrist is not moved as shown in FIG. 6, that is, when the user's wrist is straightened, the state where the information device 230 or the cover 240 is inserted is maintained in the receptacle member 200 since both the first wire 412 and the elastic member 430 are in a compressed state.

On the other hand, when the joint of the user's wrist is moved as shown in FIG. 7, that is, when the wrist is bent to one side, the connection point between the one end of the first wire 412 and the fixing member 320 is away from the connection point between the other end of the first wire 412 and the information device 230 or the cover 240 depending on the deformation of the flexible band 300, and thus a tensile force is applied to the first wire 412.

Consequently, the information device 230 or the cover 240 connected by the tensile force of the first wire 412 is pulled out from the receptacle member 200, and the user can confirm various markings and information displayed on the tool, the machine part or the information device 230. At this case, the elastic member 430 is also extended in length to exhibit its restoring force.

Then, when the joint of the user's wrist is moved and again straightened to the other side in a state where the information device 230 or the cover 240 is extracted from the receptacle member 200, the tensile force pulling the first wire 412 is reduced. At the same time, the tool, the machine part, the information device 230 or the cover 240 are automatically inserted into the receptacle member 200 by the restoring force of the elastic member 430.

Figure 8:
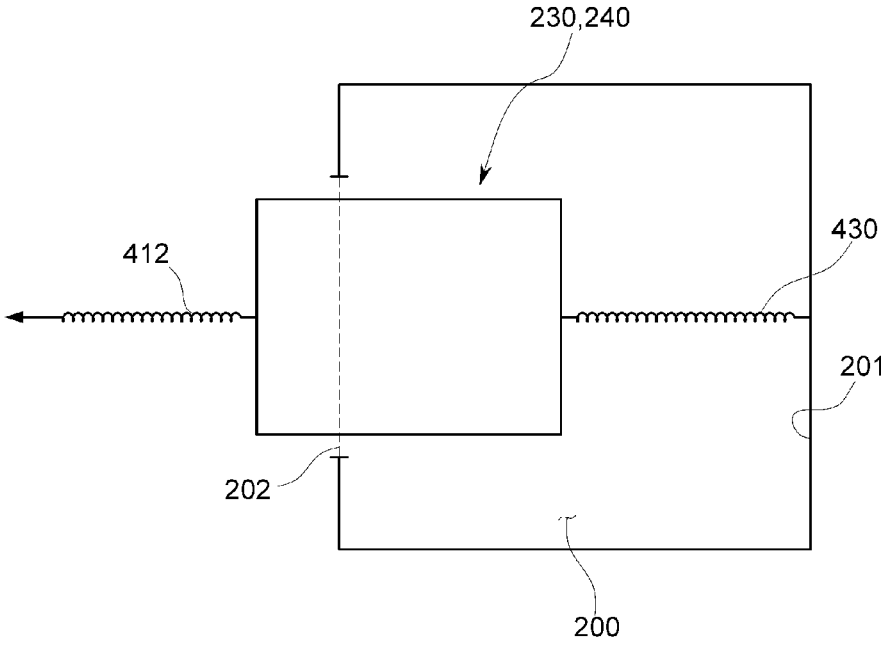
FIGS. 8 and 9 are plan views illustrating an operating state of a sliding inserting and drawing assembly of a wearable smart band using a second wire, first and second link members, and an elastic member in accordance with a second embodiment of the present disclosure.
Figure 9:
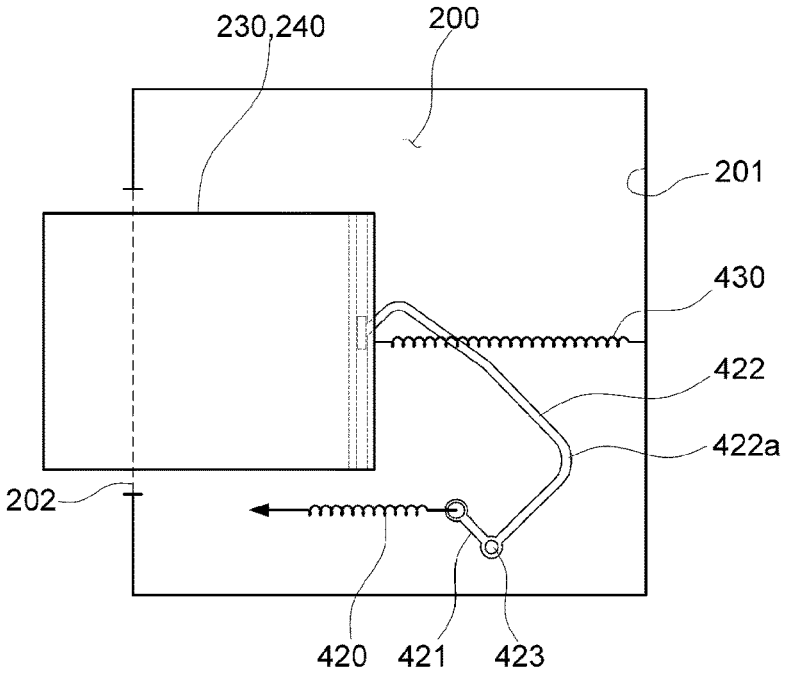

FIGS. 8 and 9 are plan views illustrating an inserting and drawing assembly of a wearable smart band in accordance with a second embodiment of the present disclosure. With reference to FIGS. 8 and 9, the construction and operation of the inserting and drawing assembly according to the second embodiment of the present disclosure will be described in detail.

Referring to FIGS. 8 and 9, the inserting and drawing assembly according to a second embodiment of the present disclosure includes a second wire 420, a first link member 421, a second link member 422, a rotating member 423, a roller or a sliding member 424, and an elastic member 430.

The second wire 420 is connected at one end to the fixing member 320 of the flexible band 300 and at the other end to other end of the first link member 421, and it is preferable for the second wire that at least one is provided. The second wire 420 may be formed of an elastic material or a non-elastic material.

The first link member 421 is provided adjacent to the side of the tool, the machine part, the information device 230 or the cover 240, and the other end thereof is connected to the other end of the second wire 420.

The second link member 422 is connected at its one end thereof to the one end of the first link member 421 by interfacing the rotary member 423 with each other and connected at its other end to the other end of the information device 230 or the cover 240 through the roller or the sliding member 424.

Further, the second link member 422 has a bending portion 422*a* formed to be bend such that one end coupled to the rotating member 423 is positioned at a side of the information device 230 or the cover 240 and the other end coupled to the rotating member 423 is positioned at the other side of the information device 230 or the cover 240. Preferably, the bending portion 422*a* is bent at an approximately right angle. Specifically, if the altitude and azimuth angle of the inserting and drawing assembly or the bending angle of the second link member 422 is adjusted with reference to the bottom surface of the receptacle member 200, the inserting and drawing direction of the inserting and drawing assembly can be adjusted.

The rotating member 423 is rotatably provided as a coupling interface between the first link member 421 and the second link member 422. When the first link member 421 is rotated in one direction by the tensile force of the second wire 420, the rotating member is rotated according to the rotation of the first link member 421, and thus the rotational force of the first link member 421 is transmitted to the second link member 422.

The roller or the sliding member 424 is provided at one end of the second link member 422 and is received in a roller guide 254 (see FIG. 3) formed on the other side of the information device 230 or the cover 240 to guide the movement of one end of the second link member 422.

That is, the roller or the sliding member 424 is provided to transmit the rotational force of the second link member 422 interlocked with the first link member 421 to the information device 230 or the cover 240 more easily.

Meanwhile, the second link member 422 may be provided at one end thereof with a sliding member and the like instead of the roller member 424 to be received in the roller guide 254. Any members may be used as long as it is guided along the roller guide 254.

The elastic member 430 may be provided with at least one to be connected at the one end to the other end of the tool, the machine part, the information device 230 or the cover 240 and at the other end to the inner side of the receptacle member 200.

In the operation of the inserting and drawing assembly, when the joint of the user's wrist is not moved as shown in FIG. 8, that is, when the user's wrist is straightened, the first link member 421, the second link member 422 and the rotating member 423 do not rotate without the force applied. Therefore, the state where the tool, the machine part, the information device 230 or the cover 240 is inserted is maintained in the receptacle member 200.

Conversely, when the joint of the user's wrist is moved as shown in FIG. 9, that is, when the wrist is bent to one side, the connection point between the one end of the second wire 420 and the fixing member 320 is away from the connection point between the other end of the second wire 420 and the other end of the first link member 421 depending on the deformation of the flexible band 300, and thus a tensile force is applied to the second wire 420.

At this case, the other end of the first link member 421 rotates in one direction (counterclockwise in FIG. 9) about the rotating member 423, and the rotating member 423 also rotates in the same direction in conjunction therewith.

Further, the second link member 422 connected to the rotating member 423 also rotates in the same direction along the direction in which the rotating member 423 rotates, and one end of the second link member 422 applies a force to push the other side of the information device 230 or the cover 240.

Consequently, a force that one end of the second link member 422 presses the other side of the information device 230 or the cover 240 pushes and draws the information device 230 or the cover 240 from the receptacle member 200. At this case, the elastic member 430 is extended in length to exhibit restoring force, and the user can confirm various markings and information displayed on the tool, the machine part or the information device 230.

Next, when the joint of the user's wrist is moved and again straightened to the other side in a state where the information device 230 or the cover 240 is extracted from the receptacle member 200, the tensile force applied to the first wire 412 is eliminated. Therefore, the first link member 421, the second link member 422 and the rotating member 423 rotate in the other direction (clockwise direction in FIG. 9) by the restoring force of the elastic member 430 that has been increased. Accordingly, as the pressing of the second link member 422 is released, the tool, the machine part, the information device 230 or the cover 240 are automatically inserted into the receptacle member 200.

Meanwhile, the roller member 424 or a sliding member capable of replacing the roller member 424 is moved along the one side or the other side of the roller guide 254, such that the roller guide 254 provided on one side of the tool, machine part, information device 230 or the cover 240 may guide the movement of one end of the second link member 422 during the drawing or inserting of the information device 230.

Figure 10:
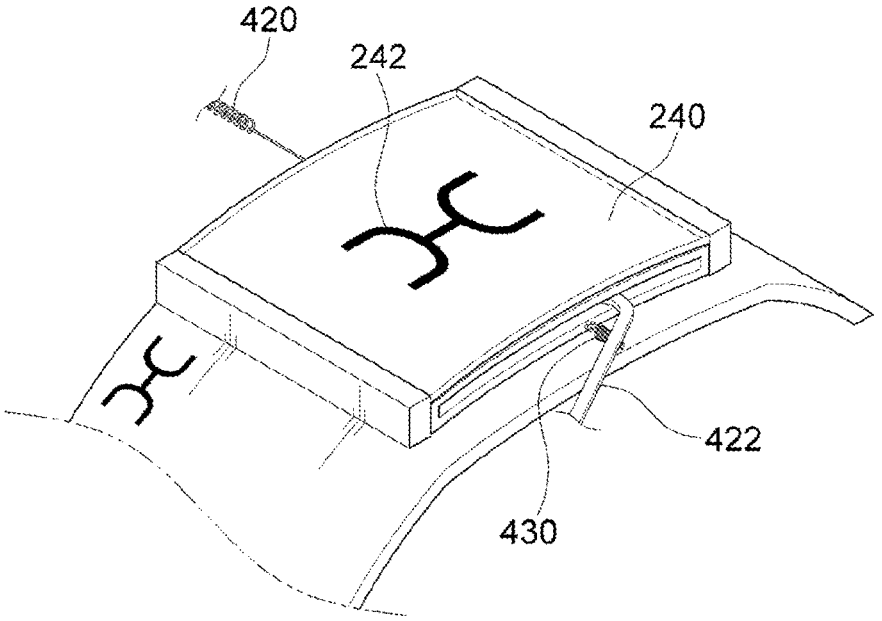
FIG. 10 is a perspective view illustrating a cover of a wearable smart band including a pattern in accordance with the present disclosure.

FIG. 10 is a perspective view showing a fixing band 100 and a cover 240 of the wearable smart band in accordance with the present disclosure. As shown in FIG. 10, a predetermined pattern 242 is formed on an outer surface or an inner surface of the cover 240 and the fixing band 100 which shield or open the receptacle member 200.

The pattern 242 may be a decorative pattern having a certain pattern, or may be a trademark of a specific company. In addition, the pattern 242 may be dynamically deformed in a shape formed by a specific shape, a number, a figure, a color, or the like. Therefore, the wearable smart band of the present disclosure can be used as an accessory because the aesthetics and the discrimination are improved due to the pattern 242 of the cover 240 or the fixing band 100.

In order to further improve the aesthetics and the identity of the pattern 242, a through hole or the like may be formed in the cover 240 or the fixing band 100 to attach or fix the jewelry or the like to one side of the cover 240. Additionally, the through hole formed in the cover 240 or the fixing band 100 may be formed in a predetermined pattern so that the jewelry or the like may be attached or fixed so as to form a pattern corresponding to the through hole or the like. In fact, the patterns, the through holes, gemstones, etc. may also be provided on the fixing member 320 and the flexible mesh 310 of the flexible band 300.

Meanwhile, the cover 240 may be provided as an analog watch or the like so that the user can know the analog time information including the hour hand, the minute hand, and the second hand when the user looks at the cover 240. At this case, the tool, the machine part, or the information device 230 may be mounted on the lower receptacle member of the analog watch serving as the cover 240.

Figure 11:
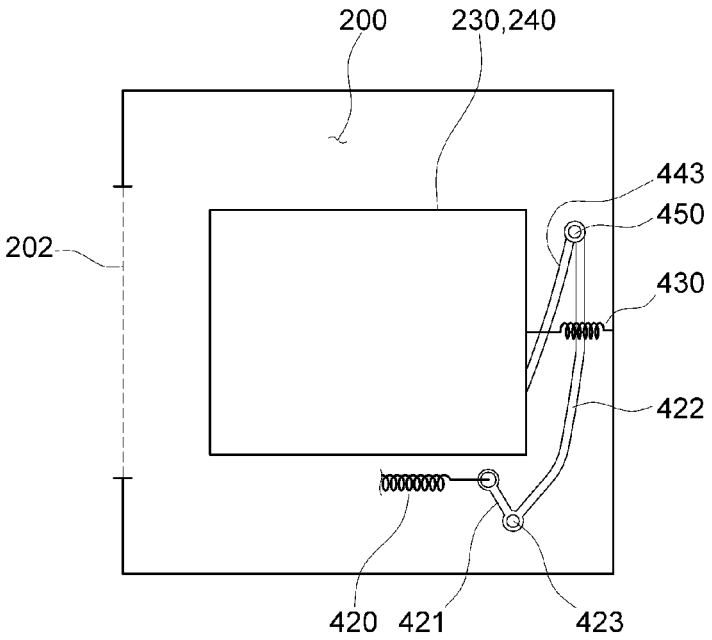
FIG. 11 is a plan view illustrating a sliding type inserting and drawing assembly of a wearable smart band in which a third link member is additionally attached to a second link member in the second embodiment and an inserting/drawing length of a machine part, an information device or a cover is extended in accordance with a third embodiment of the present disclosure.
Figure 12:
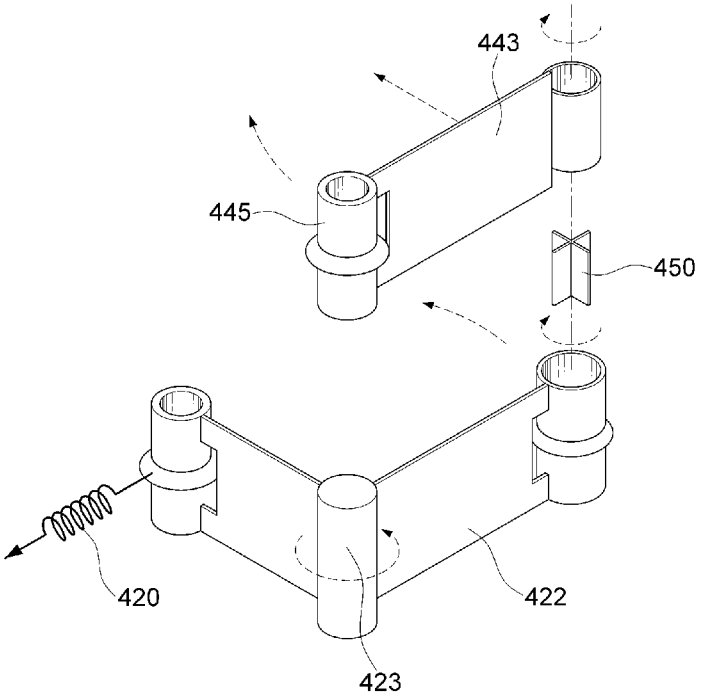
FIG. 12 is an exploded perspective view illustrating in detail the inserting and drawing assembly of the wearable smart band according to the third embodiment shown in FIG. 11.

FIG. 11 is a plan view showing an inserting and drawing assembly of a wearable smart band in accordance with a third embodiment of the present disclosure; and FIG. 12 is an exploded perspective view in more detail illustrating the inserting and drawing assembly of the wearable smart band shown in FIG. 11. The inserting and drawing assembly is an extension of the inserting and drawing assembly shown in FIGS. 8 and 9 and is connected to one end of the second link member 422. In addition, the inserting and drawing assembly includes at the other end a third link member 443 which is in contact with the other end of the information device or the cover 230, and an extended rotating member 450 rotatably provided between the second link member 422 and the third link member 443 to transmit the rotational force of the second link member 422 to the third link member 443.

In other words, when the second link member 422 rotates about the rotating member 423, the extended rotating member 450 that automatically rotates in the opposite direction of the rotating member 423 is disposed between the second link member 422 and the third link member 443. The third link member 443 is coupled to the extended rotating member 450 and a second roller member 445 is provided at an end of the third link 443. In this example, it will be readily appreciated that the second roller member 445 may then be replaced by a second slide member.

Accordingly, when the rotating member 423 rotates counterclockwise in FIG. 12, its rotational force is transmitted to the extended rotating member 450 to rotate the extended rotating member 450 in a clockwise direction. By virtue of this operation, the third link member 443 is rotated in a direction opposite to the second link member 422. In this case, the combination of the advancing directions of the second link member 422 and the third link member 443 enables the second roller member 445 to move in the same direction as the spatial movement direction, i.e., a drawing and inserting direction of the tool, the machine part, the information device 230 or the cover 240.

As a result, the tool, the machine part, the information device 230 or the cover 240 can be inserted and drawn out further by the length of the third link member 443.

Figure 13A:
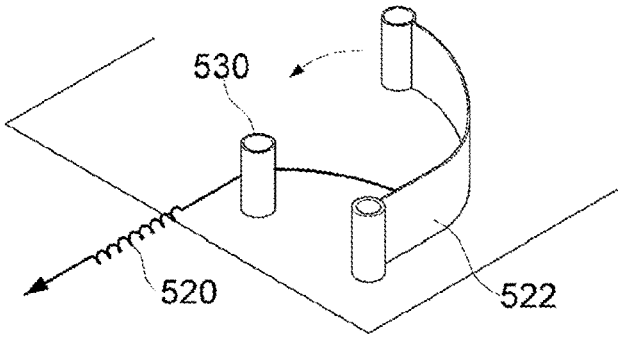
FIG. 13*a* is a perspective view illustrating an inserting and drawing assembly in which a first link is omitted from an inserting and drawing assembly of a wearable smart band according to the second and third embodiments, in accordance with a fourth embodiment of the present disclosure.
Figure 13B:
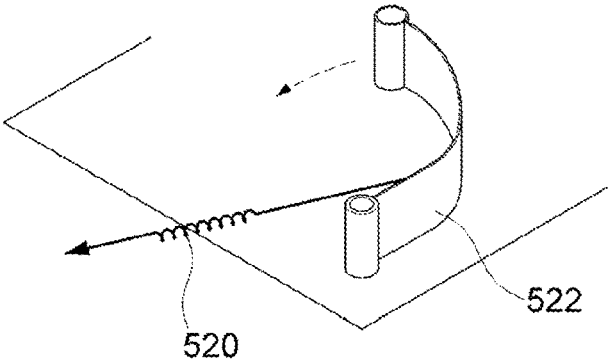
FIG. 13*b* is a perspective view illustrating an inserting and drawing assembly in which a second wire can be directly coupled to a second link by omitting a supporting member in the inserting and drawing assembly of the fourth embodiment, in accordance with a fifth embodiment of the present disclosure.

FIGS. 13*a* and 13*b* are perspective views illustrating an inserting and drawing assembly of a wearable smart band in accordance with fourth embodiment of the present disclosure. Referring to FIG. 13*a*, the inserting and drawing assembly is configured to include a second wire 520 having one end connected to the fixing member 320 of the flexible band 300, a second link member 522 having one end connected to the other end of the second wire 520 and the other end connected to the other end of the information device 230 or the cover 240, and a support member 530 for supporting the second wire 520. The inserting and drawing assembly of this fourth embodiment has the same operation in principle as that of the inserting and drawing assembly of the second embodiment already described above. Among the components, only the first link member 421 is omitted from the inserting and drawing assembly of the second embodiment, and the operations of the inserting and drawing assemblies of the second and fourth embodiments are the same as a combination of the middle portion of the second link member 522 with the operations of the first link member 421. Of course, the second wire 520 disclosed herein may be formed of an elastic material or a non-elastic material.

Alternatively, as shown in FIG. 13B, the support member 530 may be omitted from the inserting and drawing assembly of the fourth embodiment. Accordingly, the fifth embodiment of the inserting/drawing assembly may be configured such that the second wire 520 directly pulls the second link member 522 without the support point of the supporting member 530. Of course, the second wire 520 disclosed herein may also be formed of an elastic material or a non-elastic material.

This example has also the same operating principle as that of the second embodiment. In summary, the operating principle of the inserting and drawing assembly described in the second to fifth embodiments has the same characteristics in the following respects. That is, when the joint of the user's wrist is bent, the second wires 420 and 520, one end of which is connected to the fixing member 320 of the flexible band 300, are pulled and exert a tensile force to finally be rotated in the direction pulling the second link members 422 and 522. A roller member 423 connected to the other end of the second link members 422 and 522 presses the sides of the tool, the machine part, the information device 230 or the cover 240 in the rotating direction to be moved and drawn from the receptacle member 200. Once the joint of the user's wrist is straightened, the tensile forces of the second wires 420 and 520 is relieved, and the drawn tool, machine part, information device 230 or cover 240 is introduced and inserted into the receptacle member 200 by the restoring force of the expanded elastic member 430.

Meanwhile, all of the embodiments from FIG. 1 to FIG. 13B are illustrated as examples in which the tool, the machine part, the information device 230 or the cover 240 operates in a sliding manner with respect to the receptacle member 200. However, the first to fifth embodiments of the inserting and drawing assembly according to the present disclosure are not limited to the sliding type operation but also the hinge type operation manner.

A method of operating the above-described hinge type will be described with reference to FIGS. 14, 15*a* and 15*b*. Conceptually, as the sixth embodiment of the present disclosure presented in FIG. 14, when the arrangement angles are changed such that the above-described first to fifth inserting and drawing assembly embodiments operate so as to rise upward from the receptacle member's floor, there is an advantage that the tool, the machine part, the information device 230 or the cover 240 can be operated in a hinge manner.

Figure 14:
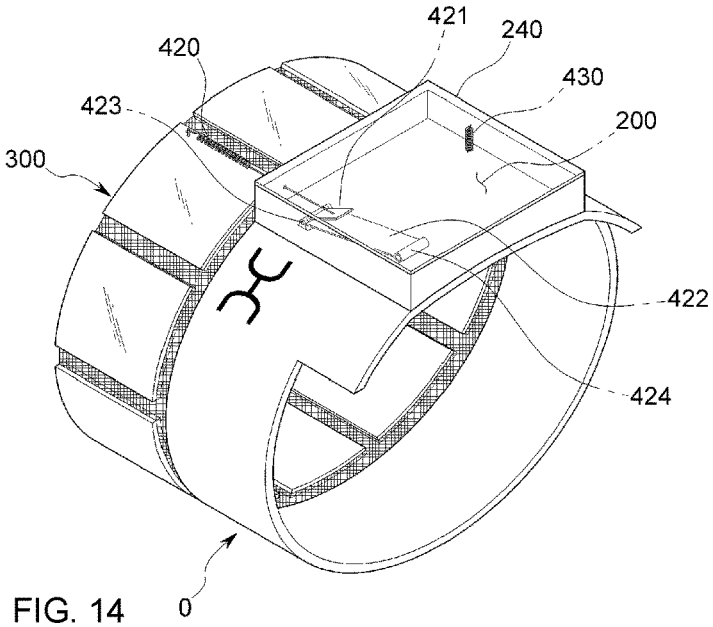
FIGS. 14, 15*a* and 15*b* are perspective views illustrating a smart band in which an inserting and drawing assembly in which the operation direction of the inserting and drawing assemblies of the first to fifth embodiments is mounted and operated in a direction in which the receptacle members rise from the floor to the top, and a tool, a machine part, an information device or a cover is inserted/drawn into/from a fixing band in a hinge manner, in accordance with a sixth embodiment of the present disclosure.
Figure 15A:
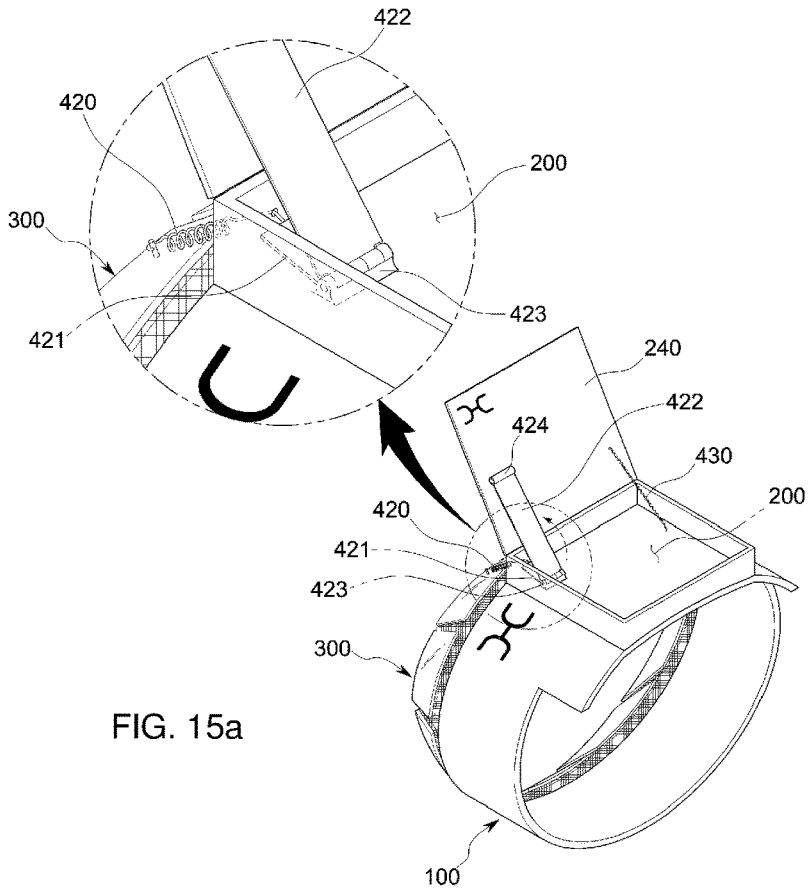
Figure 15B:
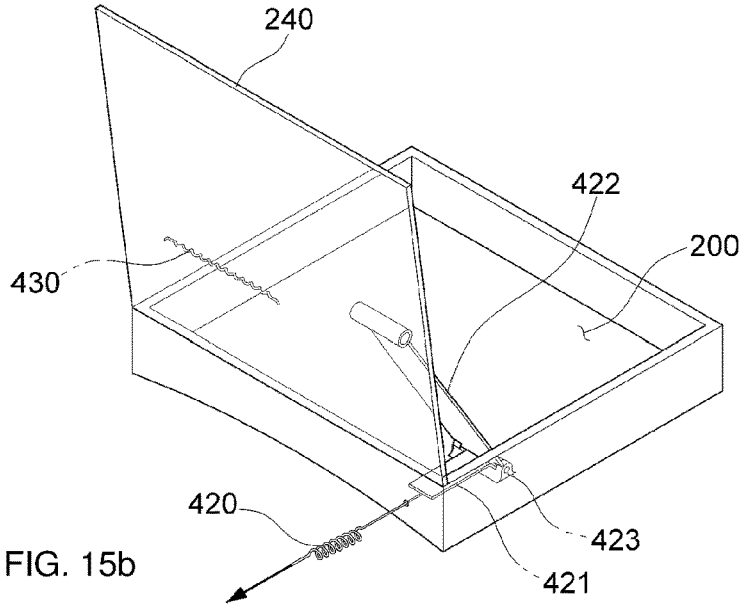

With reference to FIGS. 14, 15*a* and 15*b*, the hinge type inserting/drawing operation principle will be described as the second embodiment of the inserting and drawing assembly in detail, which includes the second wires 420 and 520, the first link member 421, the rotating member 423, the second link member 422, the roller member' 424 and the elastic member 430 in the first to fifth inserting and drawing assembly embodiments.

In FIG. 14, the first link member 421 and the second link member 422 are simultaneously connected to each other in a state in which the rotary member 423 is laid on the floor of the receptacle member 200. When the joint of the user's is then bent, the second wire 420 is pulled, and the first link member 421 and the second link member 422 connected to the rotating member 423 are moved through the receptacle member 200 in the direction of rising from the bottom surface.

In this connection, the roller member 424 connected to the other end of the second link member 422 presses or pulls one side of the information device 230 or the cover 240 such that the tool, machine part, information device 230 or cover 240 is opened and moved away from the receptacle member in a hinge manner. Then, the elastic member 430 connecting the information device 230 or the cover 240 to the bottom or one side of the receptacle member 200 expands and exerts a restoring force.

When the joint of the user's wrist is straightened, the pulling force of the second wire 420 is relieved and the restoring force of the extended elastic member 430 is activated so that the second link member 422 is rotated and moved toward the bottom surface of the receptacle member 200 and the information device 230 or the cover 240 is also rotated and introduced toward the bottom of the receptacle member.

While the present disclosure has been particularly shown and described with reference to exemplary embodiments thereof, it is to be understood that the disclosure is not limited to the disclosed embodiments, but, on the contrary, is intended to cover various modifications and equivalent arrangements included within the spirit and scope of the appended claims. Accordingly, the true scope of the present disclosure should be determined by the following claims.

DESCRIPTION OF REFERENCE NUMERALS

100: fixing band; 200: receptacle member
201: inner side; 202: drawing and inserting entry
210: first guide member; 212: guide groove
220: second guide member; 230: tool, machine part, information device
240: cover; 242: pattern
252: guide protrusion; 254: roller guide
300: flexible band; 310: mesh
320: fixing member; 412: first wire
420: second wire; 421: first link member
422: second link member; 423: rotating member
424: roller/sliding member; 430: elastic member

443: third link member; 445: second roller member
450: extended rotating member; 520: second wire
522: second link member; 530: support member

What is claimed is:

1. A wearable smart band comprising:

a fixing band provided so as to be wearable on a joint of a user including a human, an animal and a machine;

a receptacle member formed on the fixing band such that a tool, a machine part or an information device is located within the receptacle, and the receptacle having an upper part covered by a cover;

a flexible band provided on one side of the fixing band, wherein a shape of the flexible band is transformed due a joint movement of the user; and an inserting and drawing assembly having one end connected to the flexible band and the other end connected to the tool, the machine part, the information device or the cover, wherein the tool, machine part, the information device or the cover is drawn or inserted from/into the receptacle member by the transformation of the flexible band according to the joint movement of the user; and wherein the inserting and drawing assembly includes:

at least one second wire having one end connected to the flexible band;

a first link member connected to a second end of the second wire;

a second link member connected to one end of the first link member, and having one end connected to the tool, the machine part, the information device or the cover; and a rotating member rotatably or provided between the first link member and the second link member to transmit a rotational force of the first link member to the second link member, and wherein the tool, the machine part, the information device or the cover is drawn or inserted from/into the receptacle member by a rotation of the first link member and the second link member when the second wire is tensioned or compressed by deformation of the flexible band due to the joint movement of the user.

2. The wearable smart band according to claim 1, wherein the receptacle member is fixedly mounted in the fixing band, and wherein the wearable smart band has flexibility in which part or all of the shape thereof can be changed in compliance with an external force exerted by the user.

3. The wearable smart band according to claim 1, wherein the receptacle member includes a first guide member to guide the movement of the tool, the machine part, the information device or the cover to be drawn or inserted in the receptacle member, and wherein the tool, the machine part, the information device or the cover includes a guide protrusion received in a guide groove formed along a length direction of the first guide member.

4. The wearable smart band according to claim 1, wherein the flexible band includes a flexible mesh including a cloth, a leather, a rubber, a plastic or a metal material.

5. The wearable smart band according to claim 4, wherein the flexible band includes at least one fixing member to which one end of the inserting and drawing assembly is connected.

6. The wearable smart band according to claim 4, wherein the flexible band has different circumferential lengths at one end and the other end thereof.

7. The wearable smart band according to claim 1, wherein the inserting and drawing assembly includes at least one first wire having one end connected to the flexible band and the other end connected to the tool, the machine part, the information device or the cover.

8. The wearable smart band according to claim 7, wherein the first wire or the second wire is made of an elastic material.

9. The wearable smart band according to claim 1, wherein the inserting and drawing assembly further includes a roller member provided on one end of the second link member, and wherein the roller member is received in a roller guide formed on a second side of the tool, the machine part, the information device or the cover to guide the movement of the one end of the second link member.

10. The wearable smart band according to claim 1, wherein the inserting and drawing assembly further includes:

a sliding member provided on the one end of the second link member, wherein the sliding member is received in a roller guide formed on a second side of the tool, the machine part, the information device or the cover to guide the movement of the one end of the second link member.

11. The wearable smart band according to claim 1, wherein the inserting and drawing assembly further includes:

at least one elastic member having a first end connected to the second link member and a second end connected to an end of an inner side of the receptacle member.

12. The wearable smart band according to claim 1, wherein a predetermined pattern is formed on an outer surface or an inner surface of the cover, the fixing band or the flexible band.

13. The wearable smart band according claim 1, wherein the inserting and drawing assembly includes:

a third link member having a first end connected to a first end of the second link member and a second end contacted with a second side of the tool, the machine part, the information device or the cover; and an extended rotating member rotatably provided between the second link member and the third link member to transmit a rotational force of the second link member to the third link member.

14. The wearable smart band according to claim 1, wherein the inserting and drawing assembly includes:

a third wire having a first end connected to the flexible band; and a third link member connected to a second end of the third wire and having a first end connected to the tool, the machine part, the information device or the cover.

15. The wearable smart band according to claim 1, wherein the inserting and drawing assembly includes:

a third wire having a first end connected to the flexible band;

a third link member connected to a second end of the third wire and having a first end connected to the tool, the machine part, the information device or the cover; and a supporting member for changing a pulling direction of the third wire.

16. A wearable smart band comprising:

a fixing band provided so as to be wearable on a joint of a user including a human, an animal and a machine;

a receptacle member formed on the fixing band such that a tool, a machine part or an information device is located within the receptacle, and the receptacle having an upper part covered by a cover;

a flexible band provided on one side of the fixing band, wherein a shape of the flexible band is transformed due a joint movement of the user; and an inserting and drawing assembly having one end connected to the flexible band and the other end connected to the tool, the machine part, the information device or the cover, wherein the tool, machine part, the information device or the cover is drawn or inserted from/into the receptacle member by the transformation of the flexible band according to the joint movement of the user, wherein the inserting and drawing assembly includes at least one first wire having a first end connected to a first end of the flexible band and a second end connected to a first end gf the tool, the machine part, the information device or the cover, wherein the inserting and drawing assembly further includes at least one elastic member having a first end connected to a second end of the tool, the machine part, the information device or the cover and a second end connected to an end of an inner side of the receptacle member.

17. A wearable smart band comprising:

a fixing band and provided so as to be wearable on a joint of a user including a human, an animal and a machine;

a receptacle member formed on the fixing band such that a tool, a machine part or an information device is located within the receptacle, and the receptacle having an upper part covered by a cover;

a flexible band provided on one side of the fixing band, wherein a shape of the flexible band is transformed due a joint movement of the user; and an inserting and drawing assembly having one end connected to the flexible band and the other end connected to the tool, the machine part, the information device or the cover, wherein the tool, machine part, the information device or the cover is drawn or inserted from/into the receptacle member by the transformation of the flexible band according to the joint movement of the user, wherein the inserting and drawing assembly is arranged to perform an upright movement in the direction of the cover from a floor part of the receptacle member to operate the tool, the machine part, the information device or the cover in a hinge manner.

* * * * *